US009712921B2

(12) United States Patent
Salvatti et al.

(10) Patent No.: US 9,712,921 B2
(45) Date of Patent: Jul. 18, 2017

(54) HIGH ASPECT RATIO MICROSPEAKER HAVING A TWO-PLANE SUSPENSION

(71) Applicant: Apple Inc., Cupertino, CA (US)

(72) Inventors: Alexander V. Salvatti, Morgan Hill, CA (US); Pablo Seoane Vieites, Sunnyvale, CA (US); Justin D. Crosby, Cupertino, CA (US); Scott P. Porter, Cupertino, CA (US); Edward T. Sweet, San Francisco, CA (US); Daniel K. Boothe, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 167 days.

(21) Appl. No.: 14/468,178

(22) Filed: Aug. 25, 2014

(65) Prior Publication Data

US 2016/0057543 A1 Feb. 25, 2016

(51) Int. Cl.

| | |
|---|---|
| ***H04R 9/04*** | (2006.01) |
| *H04R 1/06* | (2006.01) |
| *H04R 9/02* | (2006.01) |

(52) U.S. Cl.

CPC ..... *H04R 9/04* (2013.01); *H04R 9/043* (2013.01); *H04R 1/06* (2013.01); *H04R 9/025* (2013.01);

(Continued)

(58) Field of Classification Search

CPC . H04R 9/04; H04R 9/043; H04R 1/06; H04R 2307/204; H04R 2307/207;

(Continued)

(56) References Cited

U.S. PATENT DOCUMENTS 6,490,363 B1 * 12/2002 Liu ..... H04R 9/06 381/398

6,853,734 B2 2/2005 Sahyoun (Continued)

FOREIGN PATENT DOCUMENTS

CN 202587358 12/2012

CN WO 2013007112 A1 * 1/2013 ..... H04R 9/06

(Continued)

OTHER PUBLICATIONS

International Search Report and Written Opinion, dated Nov. 5, 2015, Application No. PCT/US2015/043680.

(Continued)

*Primary Examiner* — Davetta W Goins
*Assistant Examiner* — Oyesola C Ojo
(74) *Attorney, Agent, or Firm* — Blakely, Sokoloff, Taylor & Zafman LLP

(57) ABSTRACT

A microspeaker includes a frame and a diaphragm having length sides that are longer than its width sides. A magnet is positioned below the diaphragm. A yoke includes a base portion positioned below the magnet and sidewalls which extend from the base portion, the yoke sidewalls positioned only along a length dimension of the magnet. A voice coil includes an upper end attached to a bottom face of the diaphragm and a lower end positioned within a gap formed between the length dimension of the magnet and the yoke sidewalls. A first suspension member is attached to the length sides and the width sides of the diaphragm and the frame. The first suspension member is within a first plane. A second suspension member is attached to the lower end of the voice coil and the frame. The second suspension member is in a second plane different from the first plane.

18 Claims, 7 Drawing Sheets

(52) U.S. Cl.
CPC ..... *H04R 9/046* (2013.01); *H04R 2307/204* (2013.01); *H04R 2307/207* (2013.01); *H04R 2499/11* (2013.01)

(58) Field of Classification Search
CPC .... H04R 2499/11; H04R 9/025; H04R 9/046; H04R 7/16; H04R 7/18; H04R 7/20; H04R 2207/00; H04R 2207/021; H04R 2209/00; H04R 2209/22; H04R 2307/00; H04R 2307/201; H04R 2400/07
USPC ..... 381/398, 400
See application file for complete search history.

(56) References Cited

U.S. PATENT DOCUMENTS

| | | | | |
|---|---|---|---|---|
| 7,995,788 | B2 | 8/2011 | Funahashi et al. | |
| 8,295,538 | B2 | 10/2012 | Harris et al. | |
| 8,311,263 | B2 | 11/2012 | Huang | |
| 8,426,735 | B2 | 4/2013 | Troosters et al. | |
| 8,469,741 | B2 | 6/2013 | Oster et al. | |
| 9,338,532 | B2 | 5/2016 | Yan | |
| 2001/0011615 | A1* | 8/2001 | Iwasa | H04R 7/20 181/172 |
| 2005/0147272 | A1* | 7/2005 | Hyre | H04R 9/06 381/398 |
| 2007/0071274 | A1 | 3/2007 | Andersen et al. | |
| 2008/0137901 | A1* | 6/2008 | Michno | H04R 9/00 381/407 |
| 2009/0116682 | A1* | 5/2009 | Suzuki | H04R 9/00 381/412 |
| 2009/0190792 | A1 | 7/2009 | Townsend | |
| 2009/0226028 | A1* | 9/2009 | Suganuma | H04R 7/06 381/430 |
| 2011/0274309 | A1 | 11/2011 | Doh et al. | |
| 2012/0170778 | A1 | 7/2012 | Wei | |
| 2012/0251812 | A1 | 10/2012 | Kawka et al. | |
| 2013/0016874 | A1 | 1/2013 | Huang et al. | |
| 2014/0029784 | A1 | 1/2014 | Kwon et al. | |
| 2014/0241565 | A1* | 8/2014 | Jin | H04R 7/04 381/388 |
| 2014/0270323 | A1* | 9/2014 | Permanian | H04R 9/025 381/394 |
| 2015/0256939 | A1* | 9/2015 | Zhao | H04R 9/06 381/116 |
| 2015/0357078 | A1 | 12/2015 | Lessing et al. | |
| 2016/0025669 | A1 | 1/2016 | Sun et al. | |

FOREIGN PATENT DOCUMENTS

| | | |
|---|---|---|
| KR | 20110002370 | 1/2011 |
| KR | 20130017552 | 2/2013 |
| WO | WO-2011007403 | 1/2011 |
| WO | WO-2014094776 | 6/2014 |

OTHER PUBLICATIONS

International Preliminary Report of Patentability for PCT/US2015/043680 mailed Mar. 9, 2017, 8 pages.

* cited by examiner

HIGH ASPECT RATIO MICROSPEAKER HAVING A TWO-PLANE SUSPENSION

FIELD

An embodiment of the invention is directed to a speaker having a dual suspension system, more specifically, a high aspect ratio microspeaker having a two-plane suspension system to improve diaphragm stability. Other embodiments are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakerphone loudspeakers and earpiece receivers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. Many of these devices use what are commonly referred to as "microspeakers." Microspeakers are a miniaturized version of a loudspeaker, which use a moving coil motor to drive sound output. The moving coil motor may include a diaphragm, voice coil and magnet assembly positioned within a frame. Due to height limitations, the diaphragm is typically suspended within the frame by a single plane suspension system. In some instances, the diaphragm may have a relatively high aspect ratio of length to width that can lead to an increased risk of stability problems such as an increase in the severity of the moving assembly's rocking mode. For example, as the aspect ratio of the diaphragm increases (i.e. the ratio of the long dimension, length, to the short dimension, width, increases), the risk of rocking or twisting along the length dimension of the diaphragm may increase.

SUMMARY

An embodiment of the invention is directed to a high aspect ratio microspeaker having a dual suspension system that helps to stabilize and/or suppress one or more rocking modes of a diaphragm suspended therein. Representatively, in one embodiment, the microspeaker includes a frame and a diaphragm positioned within the frame. The diaphragm may have a length and width. The length may be longer than the width. For example, a ratio of the length to the width may be 2.0 or greater such that the diaphragm is considered to have a high aspect ratio. A magnet may be positioned below the diaphragm. The microspeaker may further include a yoke that includes a base portion positioned below the magnet, and sidewalls which extend from the base portion. The yoke sidewalls may be positioned only along a length dimension (or long side) of the magnet such that magnetic gaps between the yoke sidewalls and the magnet are formed only along the length of the magnet. In this aspect, the ends of the yoke may be considered open. A voice coil having an upper end attached to a bottom face of the diaphragm and a lower end positioned within the gap formed between a long side of the magnet and the yoke sidewall may further be provided. The microspeaker may further include a primary, or first, suspension member and a secondary, or second, suspension member. The first suspension member may include an inner edge attached to the length sides and the width sides of the diaphragm and an outer edge attached to the frame. The first suspension member may be within a first plane. The second suspension member may have an inner edge attached to the lower end of the voice coil and an outer edge attached to the frame. The second suspension member may be within a second plane different from the first plane. For example, the first suspension member may be within an upper plane which is above the voice coil and the second suspension member may be in a lower plane which is below the voice coil. In one aspect, the second suspension member may be attached to, and extend from, only two of the four sides of a rectangular voice coil, in particular the width sides, to provide added stability to the diaphragm.

Another embodiment of the invention is directed to a transducer including a frame and a sound radiating surface positioned within the frame. The sound radiating surface may have length sides and width sides. The length sides may be longer than the width sides. A voice coil, having an upper end and a lower end, may be attached to a bottom face of the diaphragm at its upper end. The transducer may further include a magnet assembly. The magnet assembly may include a magnet and a yoke. The magnet and the yoke may be dimensioned to form magnetic gaps below only the length sides of the sound radiating surface. The lower end of the voice coil may be positioned within the magnetic gaps. The transducer may further include an upper suspension member and a lower suspension member. The upper suspension member may connect the sound radiating surface to the frame and be above the voice coil. The lower suspension member may connect the voice coil to the frame. In particular, the lower suspension member may be attached to a portion of the lower end of the voice coil positioned outside of the magnetic gaps such that it is below the voice coil.

Another embodiment of the invention is directed to a microspeaker having a frame and a diaphragm positioned in the frame. The diaphragm may have a high aspect ratio, for example, an aspect ratio greater than or equal to 2.0. A magnet and a yoke may be positioned below the diaphragm. The yoke may have a base portion positioned below the magnet and sidewalls which extend from the base portion along only two sides of the magnet. The microspeaker further includes a voice coil having length sides and width sides, each of the length sides and width sides having an upper end attached to a bottom face of the diaphragm and a lower end positioned within a gap formed between the magnet and the sidewalls of the yoke. An upper suspension member connects the diaphragm to the frame and is above the voice coil. A lower suspension member connects the lower end of the voice coil to the frame and is below the voice coil. The lower suspension member may be attached to the lower end of only the width sides of the voice coil to help stabilize rocking of the diaphragm.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1A:
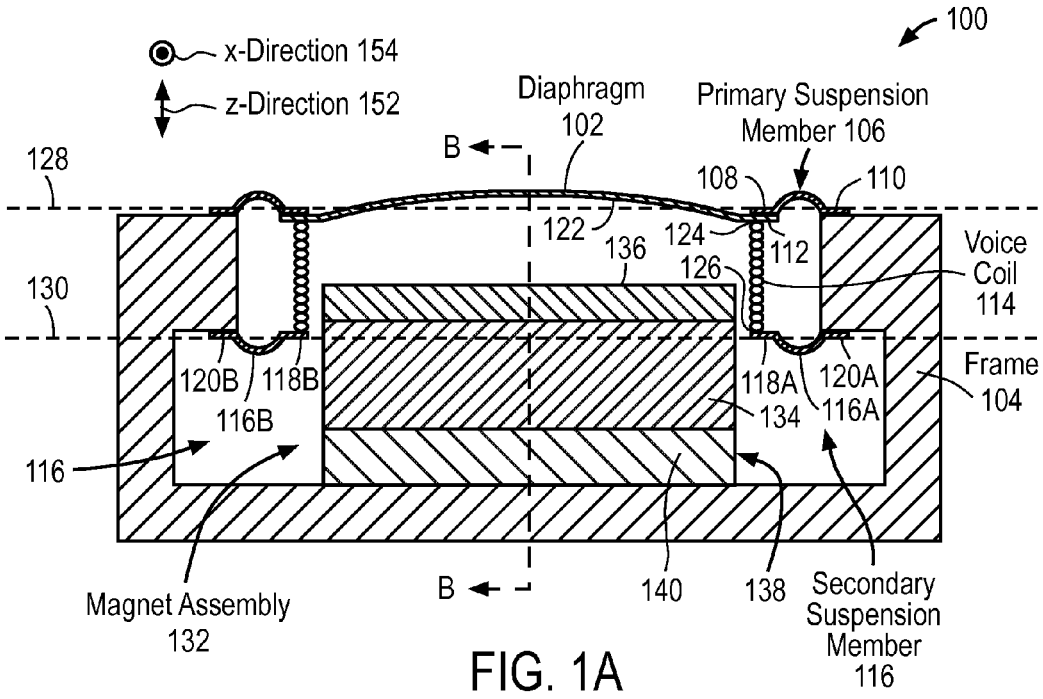
FIG. 1A illustrates a cross-sectional side view of one embodiment of a transducer.

FIG. 1A illustrates a cross-sectional side view of one embodiment of a transducer. Transducer 100 may be, for example, an electro-acoustic transducer that converts electrical signals into audible signals that can be output from a device within which transducer 100 is integrated. For example, transducer 100 may be a microspeaker such as a speakerphone speaker or an earpiece receiver found within a smart phone, or other similar compact electronic device such as a laptop, notebook, or tablet computer. Transducer 100 may be enclosed within a housing or enclosure of the device within which it is integrated. In some embodiments, transducer 100 may be considered a high aspect ratio microspeaker. The phrase "high aspect ratio" refers to a high ratio between a length dimension and a width dimension of a particular structure, in this case a microspeaker. For example, a ratio between a length dimension and a width dimension of 2.0 or greater is considered to be a "high aspect ratio."

Transducer 100 may include a sound radiating surface (SRS) or diaphragm 102. Diaphragm 102 may include a sound radiating surface and be any type of diaphragm or sound radiating surface capable of vibrating in response to an acoustic signal to produce acoustic or sound waves. In one embodiment, diaphragm 102 may have a high aspect ratio. For example, diaphragm 102 may have a length dimension and width dimension and a ratio of the length dimension (or length sides) to the width dimension (or width sides) is high, for example, 2.0 or greater. In this aspect, diaphragm 102 may have, for example, a substantially rectangular or otherwise elongated shape. FIG. 1A illustrates a cross-section through the length dimension or long side of diaphragm 102.

Transducer 100 may also include a voice coil 114 positioned along a bottom face 122 of diaphragm 102 (i.e. a face of diaphragm 102 facing magnet assembly 132). For example, in one embodiment, voice coil 114 includes an upper end 124 and a lower end 126. The upper end 124 may be directly attached to the bottom face 122 of diaphragm 102, such as by chemical bonding or the like. In another embodiment, voice coil 114 may be wrapped around a former or bobbin and the former or bobbin is directly attached to the bottom face 122 of diaphragm 102. In one embodiment, voice coil 114 may have a similar profile and shape to that of diaphragm 102. For example, where diaphragm 102 has length sides greater than the width sides (e.g. a rectangular shape), voice coil 114 may also have length sides (i.e. a length dimension) that are greater than its width sides (i.e. a width dimension). For example, voice coil 114 may have a substantially rectangular or racetrack shape. The ratio of the length sides to the width sides may be such that voice coil 114 is considered to have a high aspect ratio, for example, an aspect ratio greater than or equal to 2.0.

Diaphragm 102, with voice coil 114 attached thereto, may be suspended within frame 104 by a primary suspension member 106 and a secondary suspension member 116. In one embodiment, each of primary suspension member 106 and secondary suspension member 116 may have what is considered a "rolled" configuration in that they have a bowed or curved region which allows for greater compliance in the z-direction 152, and in turn, facilitates an up and down movement, also referred to as a vibration, of the diaphragm 102. Primary suspension member 106 and secondary suspension member 116 may be within different planes. For example, primary suspension member 106 may be in one plane 128 and secondary suspension member 116 may be in another plane 130. Plane 128 may be considered an upper plane while plane 130 may be considered a lower plane such that primary suspension member 106 is an upper suspension member (i.e. above secondary suspension member 116) and secondary suspension member 116 is a lower suspension member (i.e. below primary suspension member 106). Said another way, primary suspension member 106 may be above voice coil 114 and secondary suspension member 116 may be below voice coil 114.

Primary suspension member 106 may be the primary means by which diaphragm 102 is suspended within frame 104 and which allows for diaphragm 102 to act as a sound radiating surface. In this aspect, primary suspension member 106 may include an inner edge 108 and an outer edge 110. The inner edge 108 may be attached (e.g. adhered or chemically bonded) along a perimeter edge 112 of diaphragm 102 and the outer edge 110 may be attached (e.g.

adhered or chemically bonded) to frame 104. Primary suspension member 106 may be attached around all sides of diaphragm 102 such that diaphragm 102 is essentially sealed around all sides to frame 104. In this aspect, where diaphragm 102 has a high aspect ratio, or rectangular shape, primary suspension member 106 may have a similar profile.

Secondary suspension member 116 may provide a secondary means by which diaphragm 102, and voice coil 114, are suspended within frame 104. In this aspect, the primary purpose of secondary suspension member 116 may be to provide stability to diaphragm 102. For example, secondary suspension member 116 may be configured to suppress a rocking mode of the diaphragm. The term "rocking" or "rocking mode" refers to an undesirable rocking that can happen to speaker diaphragms (or other speaker components) at certain frequencies. Representatively, at certain frequencies, the diaphragm may begin to rock or otherwise move out of phase in an undesirable non-axial direction with respect to other components (e.g. the suspension member) and therefore a decrease in sound pressure output from the transducer may occur. By stabilizing the diaphragm (i.e. suppressing the rocking mode), the frequency at which diaphragm rocking occurs may be increased to a frequency which is, for example, above the working range of the transducer. The higher the frequency of the rocking mode is made, the less severe its effect tends to be, making it less detrimental to the performance of the device.

In the case of a high aspect ratio diaphragm such as diaphragm 102, one rocking mode may occur along a longitudinal axis (i.e. axis running along the length dimension) and another rocking mode may occur along a lateral axis (i.e. axis running along the width dimension) of diaphragm 102. Said another way, diaphragm 102 may be subject to a first rocking mode which can be described as twisting along the length dimension (i.e. rocking or tilting from side to side along the longitudinal axis) and a second rocking mode which can be described as rocking or tilting forward and backward along the lateral axis. Secondary suspension member 116 is therefore designed to suppress one or more of these rocking modes.

Representatively, in one embodiment, secondary suspension member 116 may include a first section 116A and a second section 116B. Each of the first section 116A and second section 116B may be entirely separate structures that are separately attached to voice coil 114. In other words, first section 116A and second section 116B are not directly connected to one another. The first section 116A may be attached to one of the width sides of voice coil 114 and the second section 116B may be attached to another of the width sides of voice coil 114. In one embodiment, each of first section 116A and second section 116B may be attached to only the width sides of voice coil 114. In other words, suspension member 116 is not present along (e.g. is not directly in contact with) the length sides of voice coil 114. In this aspect, first section 116A and second section 116B may be considered to radiate outwardly from each of the width sides of voice coil 114. Representatively, first section 116A may include an inner edge 118A and an outer edge 120A. The inner edge 118A may be attached (e.g. by an adhesive or chemical bonding), to the lower end of one of the width side of voice coil 114 and the outer edge 120A may be attached (e.g. by an adhesive or chemical bonding) to frame 104. Similarly, second section 116B may include an inner edge 118B and an outer edge 120B. The inner edge 118B may be attached (e.g. by an adhesive or chemical bonding), to the lower end of the other width side of voice coil 114 and the outer edge 120B may be attached to the frame 104. Since the voice coil 114 is attached to diaphragm 102, both the voice coil 114 and diaphragm 102 are supported and/or suspended within frame 104 by secondary suspension member 116. Alternatively, where voice coil 114 is wrapped around a former or bobbin, first and second sections 116A, 116B of secondary suspension member 116 may be optionally attached to a lower end of the former or bobbin.

First section 116A and second section 116B may be of a size and shape operable to suppress one or more of the previously discussed rocking modes of diaphragm 102. Representatively, in one embodiment, first section 116A and second section 116B may be configured to be stiffer in an x-direction 154 than in a z-direction 152. Said another way, first section 116A and second section 116B may be more compliant in a z-direction 152 than in an x-direction 154. In this aspect, due to the stiffness of first and second sections 116A, 116B and their location along the width sides of voice coil 114 (and, in turn, diaphragm 102) the rocking modes of diaphragm 102 along the longitudinal axis and lateral axis of diaphragm 102 are suppressed without suppressing a vibrational (or up and down) movement of diaphragm 102 in the z-direction 152. The specific shape and dimensions of first section 116A and 116B will be discussed in more detail in reference to, for example, FIG. 3 and FIG. 5.

Transducer 100 may further include a magnet assembly 132. Magnet assembly 132 may include a magnet 134 (e.g. a NdFeB magnet), with a top plate 136 and a yoke 138 for guiding a magnetic circuit generated by magnet 134. Magnet assembly 132, including magnet 134, top plate 136 and yoke 138, may be positioned below diaphragm 102, in other words, magnet assembly 132 is positioned between diaphragm 102 and frame 104. In one embodiment, magnet 134 may be a center magnet positioned entirely within an open center of voice coil 114. In this aspect, magnet 134 may have a similar profile as voice coil 114, for example, length sides which are greater than its width sides, for example, a rectangular or elliptical shape.

Figure 1B:
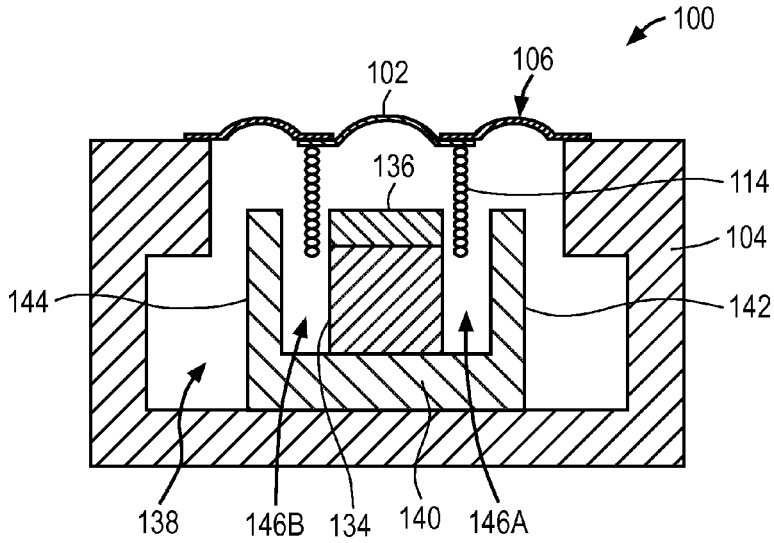
FIG. 1B illustrates a cross-sectional side view of the transducer of FIG. 1A along line B-B'.

Yoke 138 may be dimensioned to allow secondary suspension member sections 116A and 116B to extend from the width sides of voice coil 114 to frame 104. Representatively, yoke 138 may include cutout sections near the width sides of voice coil 114. For example, as can be seen from FIG. 1A, which is a cross-section along the length dimension of yoke 138 and FIG. 1B which is a cross-section along line B-B' of FIG. 1A, in other words a width dimension of yoke 138, yoke 138 includes a base portion 140 below magnet 134 and sidewalls 142, 144. Sidewalls 142, 144 extend from base portion 140 only along the length sides of magnet 134 and voice coil 114. In other words, when transducer 100 is viewed from the length side (i.e. FIG. 1A), yoke 138 looks like a substantially planar structure but when viewed from the width side (i.e. FIG. 1B), yoke 138 appears as a channel or substantially "U" shaped type structure. In this aspect, magnetic gaps 146A and 146B between magnet 134 and yoke 138 are formed only along the length sides or length dimension of voice coil 114, and in turn only below the length sides of diaphragm 102. In this aspect, only the lower end of the length sides of voice coil 114 are positioned within magnetic gaps 146A and 146B. In this aspect, the magnetic field produced within magnetic gaps 146A and 146B can be used to drive movement of voice coil 114. In other embodiments, to accommodate the secondary suspension member sections 116A and 116B extending from the width sides of voice coil 114 to frame 104, sections 116A and 116B may include cutout central regions and yoke 138 may include narrow sidewalls along the width sides of the magnet 134 and voice coil 114, and fit within the center cutout regions such that sections 116A and 116B can extend to the frame. In this aspect, the yoke sidewalls are considered to be primarily along the length dimension of magnet 134 and voice coil 114.

It is noted that since magnetic gaps 146A and 146B are formed along the long sides of voice coil 114 and diaphragm 102, a sufficient force is generated to drive movement of voice coil 114, and in turn, a vibration of diaphragm 102, in the absence of a strong magnetic force along the width sides of voice coil 114 where no yoke side walls are present. In particular, in the case of microspeakers having a length side (or dimension) longer than the width side (or dimension), the force generated by the voice coil to vibrate the diaphragm is the sum of the force generated by the long side or dimension of the voice coil and the force generated by the short side or dimension of the voice coil. As the aspect ratio increases, however, the short side contributes less of the total force generated as compared to the long side. In fact, in the case of a high aspect ratio voice coil, the force generated by the short sides of the voice coil become virtually negligible. In this aspect, when the short sides of the voice coil generate negligible force, any effect on acoustic performance due to eliminating the magnetic gap along the short side by removing the yoke within this region is negligible.

Figure 2:
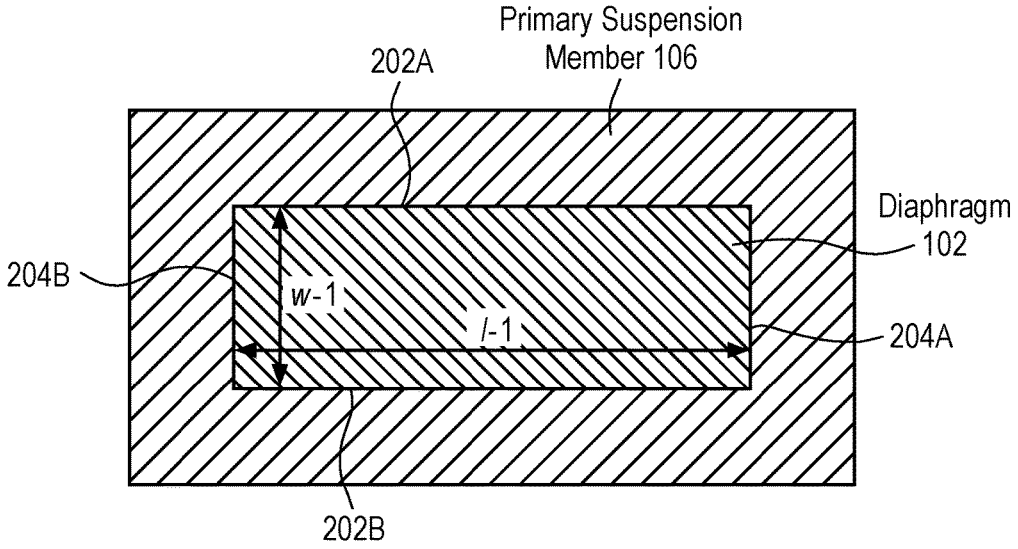
FIG. 2 illustrates a top plan view of a diaphragm and a primary suspension member of the transducer of FIG. 1A.
Figure 3:
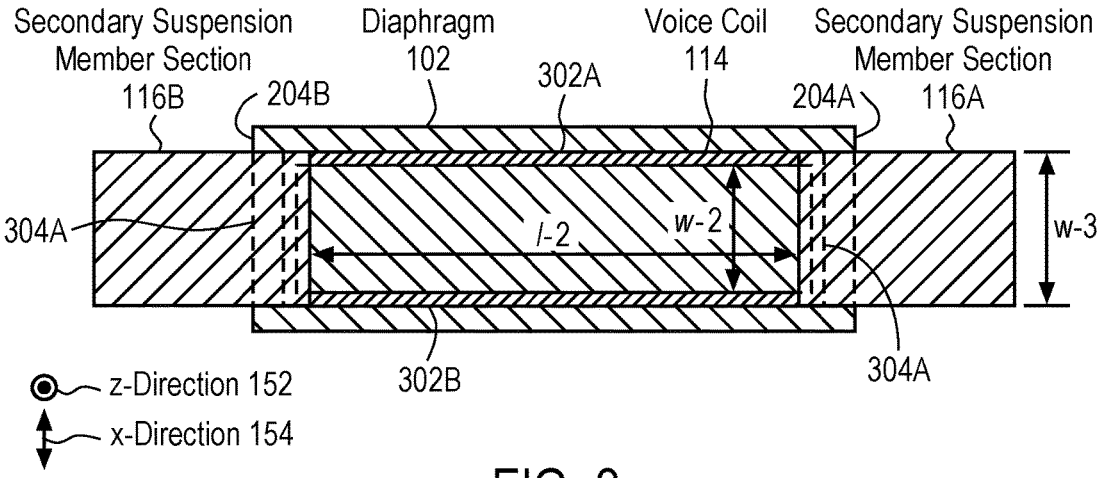
FIG. 3 illustrates a bottom plan view of a diaphragm and a secondary suspension member of the transducer of FIG. 1A.

The specific aspects of the primary suspension member 106 and secondary suspension member 116 will now be described in more detail in reference to FIG. 2 and FIG. 3. Representatively, FIG. 2 illustrates a top plan view of the diaphragm and the primary suspension member of the transducer of FIG. 1A. FIG. 3 illustrates a bottom plan view of the diaphragm and secondary suspension member of the transducer of FIG. 1A.

Returning to FIG. 2, from this view, it can be seen that diaphragm 102 has a length dimension (l-1) and a width dimension (w-1). The length dimension (l-1) is longer than the width dimension (w-1). In some embodiments, the ratio of the length dimension (l-1) to width dimension (w-1) is high such that diaphragm 102 is considered to have a high aspect ratio. For example, the ratio of l-1 to w-1 is greater than or equal to 2.0. Said another way, diaphragm 102 includes length sides 202A and 202B and width sides 204A and 204B. The length sides 202A, 202B are longer than the width sides 204A, 204B. In the case of a high aspect ratio diaphragm 102, the ratio of the length sides 202A, 202B to width sides 204A, 204B is greater than or equal to 2.0. Primary suspension member 106 extends entirely around diaphragm 102. In some cases, primary suspension member 106 has as similar profile to that of diaphragm 102, for example, a rectangular profile. Primary suspension member 106 may be sealed to each of the length sides 202A, 202B and width sides 204A, 204B of diaphragm 102 such that diaphragm 102 can be attached on all sides to the frame 104.

In contrast, as can be seen from FIG. 3, which shows diaphragm 102, voice coil 114 and secondary suspension member 116 from the bottom sides, secondary suspension member 116 is attached to only the width sides of voice coil 114 and is therefore below only the width sides 204A, 204B of diaphragm 102. In particular, voice coil 114 may have a similar profile and shape as diaphragm 102. In other words, voice coil 114 may have a length dimension (l-2) and a width dimension (w-2). The length dimension (l-2) may be longer than the width dimension (w-2). In some embodiments, the ratio of the length dimension (l-2) to width dimension (w-2) is high such that voice coil 114 is considered to have a high aspect ratio. For example, the ratio of l-2 to w-2 is greater than or equal to 2.0. Said another way, voice coil 114 includes length sides 302A and 302B and width sides 304A and 304B. The length sides 302A, 302B are longer than the width sides 304A, 304B. In the case of a high aspect ratio voice coil 114, the ratio of the length sides 302A, 302B to width sides 304A, 304B is greater than or equal to 2.0.

In order to provide stability to diaphragm 102 against rocking modes, as previously discussed, the first section 116A and second section 116B of secondary suspension member 116 are attached to only the width sides 304A, 304B of voice coil 114, respectively. By attaching sections 116A, 116B of suspension member 116 to only the width sides 304A, 304B of voice coil 114, which is attached to diaphragm 102, a stability of diaphragm 102 can be improved. More specifically, sections 116A, 116B are stiffer (i.e. less compliant) in the x-direction 154 that in the z-direction 152. Because sections 116A, 116B are in turn attached to the width sides 304A, 304B of voice coil 114, which are attached to the width sides 204A, 204B of diaphragm 102, rocking or twisting of diaphragm 102 along its longitudinal axis (axis perpendicular to the x-direction 154) can be suppressed and/or reduced. In addition, a second rocking mode (i.e. front to back movement of the diaphragm 102 along the lateral axis, which is parallel to x-direction 154) can also be suppressed by sections 116A, 116B.

In one embodiment, sections 116A, 116B have a greater stiffness in the x-direction 154 due to their size and shape. Representatively, sections 116A, 116B may have a width dimension (w-3) which is equal to that of voice coil 114. For example, sections 116A, 116B may have the profile of a parallelogram (e.g. a rectangle) in which the width dimension (w-3) is the same as that of the voice coil 114. In addition, sections 116A, 116B may be solid membranes which have no openings therefore further increasing the stiffness in the x-direction 154. Sections 116A, 116B may also be made of a relatively thin material such as thin polyimide film such as Kapton® and/or a meta-aramid material such as Nomex® which allows for a higher stiffness in the x-direction 154 while still maintaining compliance (or lower stiffness) in the z-direction so as not to interfere with the up and down movement (i.e. vibration) of diaphragm 102.

It is noted that as can be seen from FIG. 3, only the width sides 304A, 304B, and not the length sides 302A, 302B, of voice coil 114 are in contact with sections 116A, 116B of secondary suspension member 116. The length sides 302A, 304B of voice coil 114, and in turn diaphragm 102, are therefore free of any sort of secondary suspension member. Such a configuration further allows for the desired rocking mode suppression while still maintaining the desired compliance in the z-direction 152 so as not to interfere with a vibration of diaphragm 102.

Figure 4:
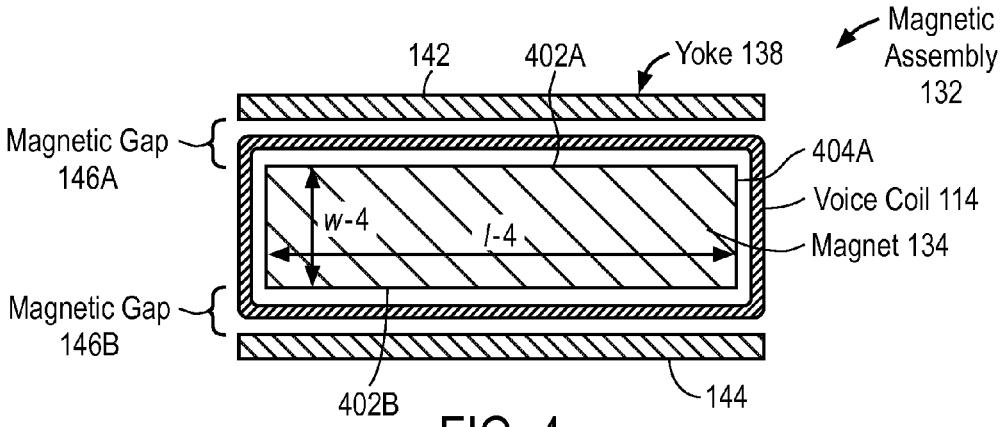
FIG. 4 illustrates a top plan view of a magnet assembly of the transducer of FIG. 1A.

FIG. 4 illustrates a top plan view of a magnet assembly of the transducer of FIG. 1A. This view further illustrates that magnet 134 may have a length dimension (l-4) which is longer than the width dimension (w-4). In other words, magnet 134 may have length sides 402A, 402B and width sides 404A, 404B. In some cases, an aspect ratio of length sides 402A, 402B to width sides 404A, 404B is high, for example, greater than or equal to 2.0 such that magnet 134 is considered to have a high aspect ratio. As can be further seen from this view, the sidewalls 142, 144 of yoke 138 are only along the length sides 402A, 402B of magnet 134 such that magnetic gaps 146A, 146B are formed only along the length sides 402A, 402B of magnet 134. These magnetic gaps 146A, 146B are in turn, only below the length sides of voice coil 114 and diaphragm 102 as previously discussed. The ends of yoke 138 are therefore considered cut off, or open, such that there is room for secondary suspension member sections 116A, 116B to extend from the width sides of voice coil 114 and out yoke 138 to the frame 104.

Figure 5:
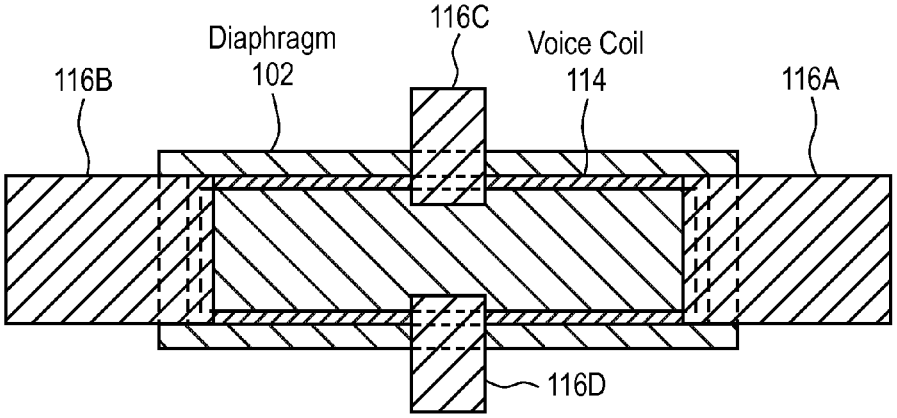
FIG. 5 illustrates a bottom plan view of another embodiment of a diaphragm and a secondary suspension member of a transducer.

FIG. 5 illustrates a bottom plan view of another embodiment of a diaphragm and a secondary suspension member of a transducer. In this embodiment, the secondary suspension member includes four sections, namely the previously discussed first and second sections 116A, 116B, which extend from the width sides of voice coil 114, as well as third and fourth sections 116C and 116D which extend from length sides of voice coil 114 for added stability. The third and fourth sections 116C, 116D may be substantially similar to sections 116A, 116B in size and shape, the only difference being they are attached to and radiate outwardly from the length dimension of voice coil 114.

Figure 6:
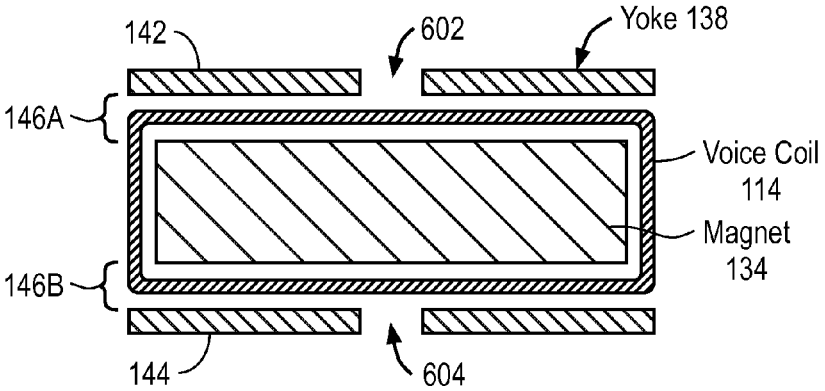
FIG. 6 illustrates a top plan view of another embodiment of a magnet assembly used with the transducer of FIG. 5.

FIG. 6 illustrates a top plan view of another embodiment of a magnet assembly used with the transducer configuration of FIG. 5. Representatively, in order to accommodate the third and fourth suspension member sections 116C, 116D as previously discussed, yoke 138 includes additional cut out sections 602 and 604 within the sidewalls 142, 144, respectively. The cut out sections 602, 604 are of a size and shape sufficient to allow sections 116C, 116D to extend through them and connect to the frame 104, while still allowing magnetic gaps 146A, 146B to generate a sufficient magnetic force to drive movement of diaphragm 102. In other words, cut out sections 602, 604, and in turn, suspension sections 116C and 116D, should be relatively narrow so that a substantial portion of the sidewalls 142, 144, which form the magnetic gaps to drive voice coil 114, are maintained.

Figure 7:
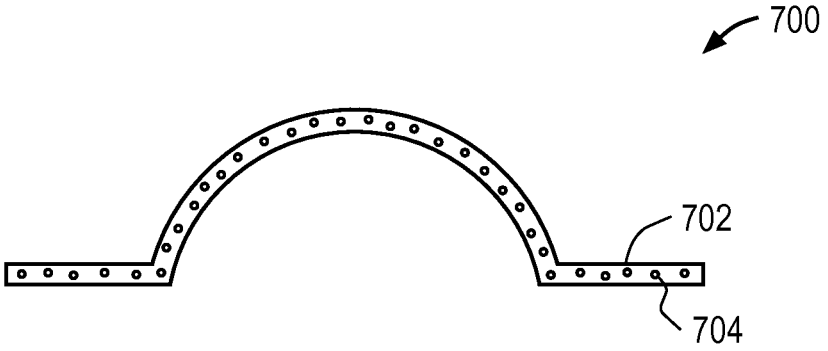
FIG. 7 illustrates a cross-sectional side view of one embodiment of a conductive suspension member.

FIG. 7 illustrates a cross-sectional side view of one embodiment of an electrically conductive suspension member. Suspension member 700 may be any one or more of the previously discussed suspension members, namely primary suspension member 106 or secondary suspension member 116, which are used to suspend a diaphragm and/or voice coil within a transducer as will be discussed in more detail in reference to FIG. 9 and FIG. 10. Suspension member 700 may be, in this embodiment, an electrically conductive suspension membrane which can be used to electrically connect the voice coil of the transducer to the frame. Representatively, suspension member 700 may include a film or membrane 702 which is doped with a conductive dopant 704. The film or membrane 702 may be, for example, made of a thermoformable plastic material, for example, a polyurethane (PU), a thermoplastic polyurethane (TPU), polyether ether ketone (PEEK) or the like. The conductive dopant 704 may be any conductive material suitable for doping a thermoformable plastic. For example, the conductive material may be a carbon nanotube. The film or membrane 702 may be formed and then doped with a conductive dopant 704, or may be doped before membrane formation according to any standard doping technique.

Figure 8:
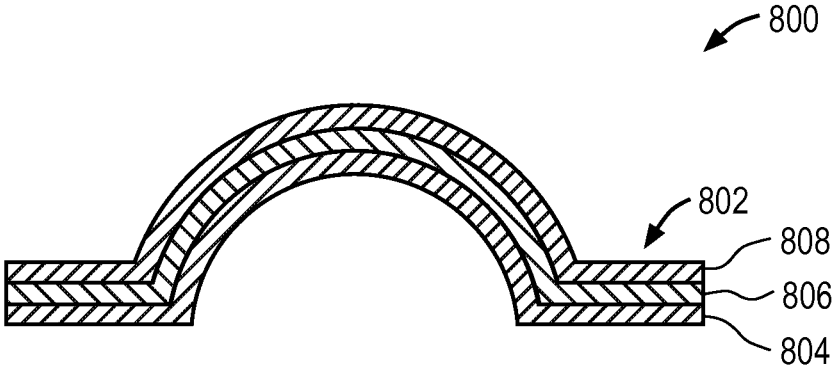
FIG. 8 illustrates a cross-sectional side view of another embodiment of a conductive suspension member.

FIG. 8 illustrates a cross-sectional side view of another embodiment of a conductive suspension member. Suspension member 800 may also be an electrically conductive membrane or film which can be used as a primary suspension member or a secondary suspension member to electrically connect the voice coil to the frame, except in this embodiment, suspension member 800 is made of a multilayered membrane 802. Representatively, the multilayered membrane 802 may include a bottom layer 804, a middle layer 806 and a top layer 808. One of layers 804, 806 and 808 may be made of a conductive material. For example, in one embodiment, where the bottom layer 804 is to be in contact with the voice coil and provide an electrical connection to the frame, the bottom layer 804 may be made of a conductive material, the middle layer 806 may be made of an adhesive material and the top layer 808 may be made of a non-conductive material. In other embodiments, where the top layer 808 is to be in contact with the voice coil and provide an electrical connection to the frame, the top layer 808 may be made of a conductive material, the middle layer 806 may be made of an adhesive and the bottom layer 804 may be made of a non-conductive material. In both cases, the middle adhesive layer 806 may be used to adhere or bond the top layer 808 to the bottom layer 804. It is further to be understood that although three layers are shown, more or fewer layers may be used as desired. For example, top layer 808 may be attached to bottom layer 804 by a chemical bonding technique and the middle adhesive layer 806 omitted. In this way, one layer may be optimized for best electrical conductivity while another layer may be optimized for best mechanical properties.

Figure 9:
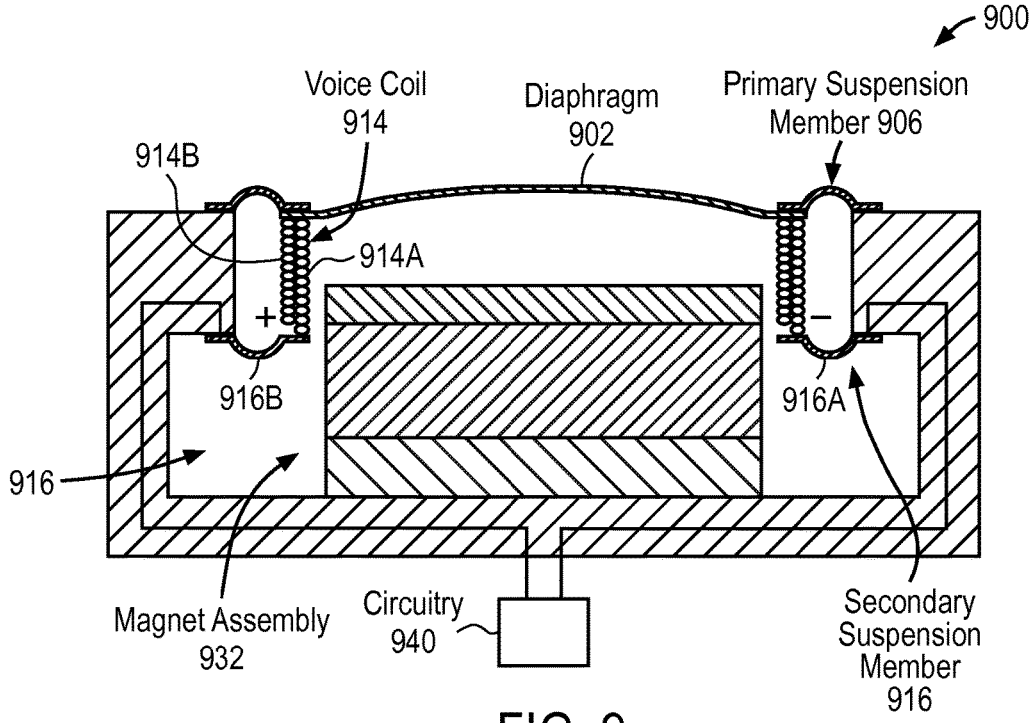
FIG. 9 illustrates a cross-sectional side view of an embodiment of a transducer including a conductive suspension member.

FIG. 9 illustrates a cross-sectional side view of a transducer including a conductive suspension member. Transducer 900 is substantially similar to transducer 100 previously discussed in reference to FIG. 1A. Representatively, transducer 900 includes a diaphragm 902 and voice coil 914 which are suspended from frame 904 by a primary suspension member 906 and a secondary suspension member 916. The secondary suspension member 916 may include a first section 916A and a second section 916B attached to the bottom end of voice coil 914 as previously discussed. A magnet assembly 932, such as previously discussed magnet assembly 132, is positioned below the diaphragm 902. In this embodiment, the first section 916A and second section 916B of secondary suspension member 916 are shown as being conductive suspension members such as those described in reference to FIG. 7 and FIG. 8. The conductive suspension member sections 916A, 916B are attached directly to the negative (−) and positive (+) terminals along the bottom end of voice coil 914, respectively, at one end, and to circuitry 940 running through frame 904, at another end. For example, in one embodiment, voice coil 914 may be a double wound coil having an inner layer 914A electrically connected to the positive (+) terminal and an outer layer 914B electrically connected to the negative (−) terminal. In this aspect, sections 916A, 916B can be used to electrically connect voice coil 914 to circuitry 940 within frame 904 without the need for lead wires which may be susceptible to breakage or fatigue during the normal operation of the transducer. This concept may be extended to any number of layers used in the coil construction, for example an even number of layers (e.g. 2, 4, 6, etc.) could be used when the connections are to be made to the same end of the coil, or an odd number of layers (e.g., 1, 3, 5, etc.) could be used if it were desired to make the (+) and (−) connection on opposite ends of the coil.

Figure 10:
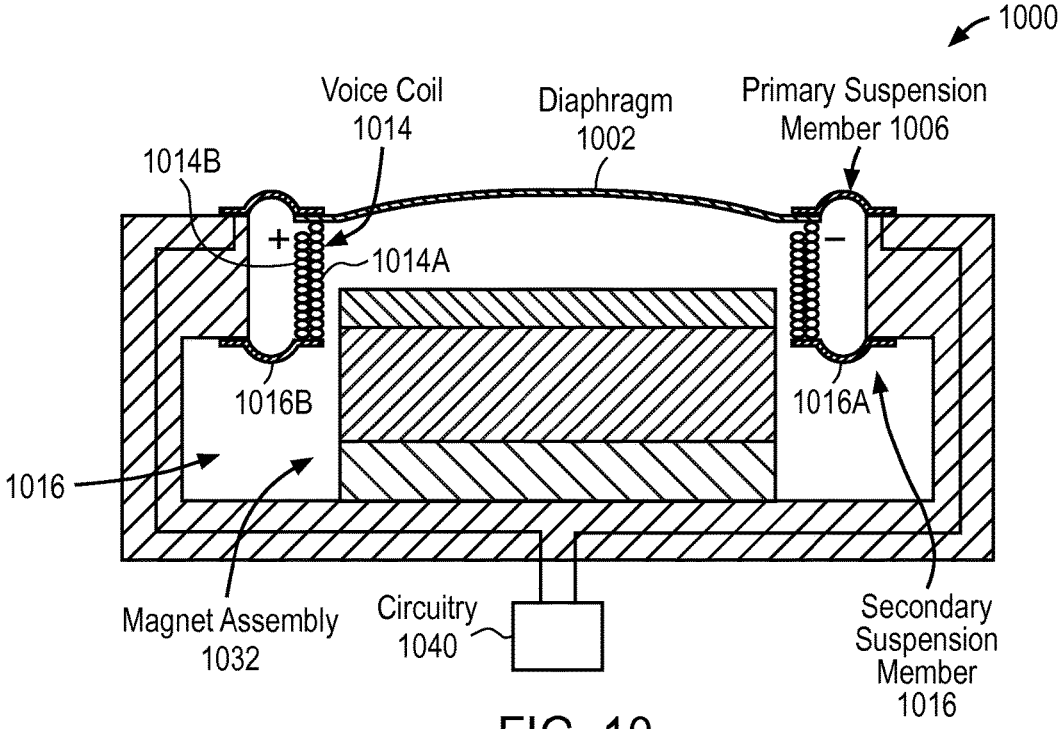
FIG. 10 illustrates a cross-sectional side view of another embodiment of a transducer including a conductive suspension member.

FIG. 10 illustrates a cross-sectional side view of another embodiment of a transducer including a conductive suspension member. Transducer 1000 is substantially similar to transducer 100 previously discussed in reference to FIG. 1A. Representatively, transducer 1000 includes a diaphragm 1002 and voice coil 1014 which are suspended from frame 1004 by a primary suspension member 1006 and a secondary suspension member 1016. The secondary suspension member 1016 may include a first section 1016A and a second section 1016B attached to the bottom end of voice coil 1014 as previously discussed. A magnet assembly 1032, such as previously discussed magnet assembly 132, is positioned below the diaphragm 1002. In this embodiment, the primary suspension member 1006 is shown as being a conductive suspension member such as those described in reference to FIG. 7 and FIG. 8. The conductive primary suspension member 1006 is attached directly to the negative (−) and positive (+) terminals at a top end of voice coil 1014 and to circuitry 1040 running through frame 1004. For example, in one embodiment, voice coil 1014 may be a double wound coil having an inner layer 1014A electrically connected to the positive (+) terminal and an outer layer 1014B electrically connected to the negative (−) terminal. In this aspect, primary suspension member 1006 can be used to electrically connect voice coil 1014 to circuitry 1040 within frame 1004 without the need for lead wires which may be susceptible to breakage. It is noted that in cases where primary suspension member 1006 is one continuous membrane, such as primary suspension member 106 discussed in reference to FIG. 2, a conductive break may be formed within the membrane so as not to short circuit an electrical current through voice coil 1014. The conductive break may be, for example, an area of non-conductivity between, for example, a left and right side, or a top and bottom, of the membrane.

Figure 11:
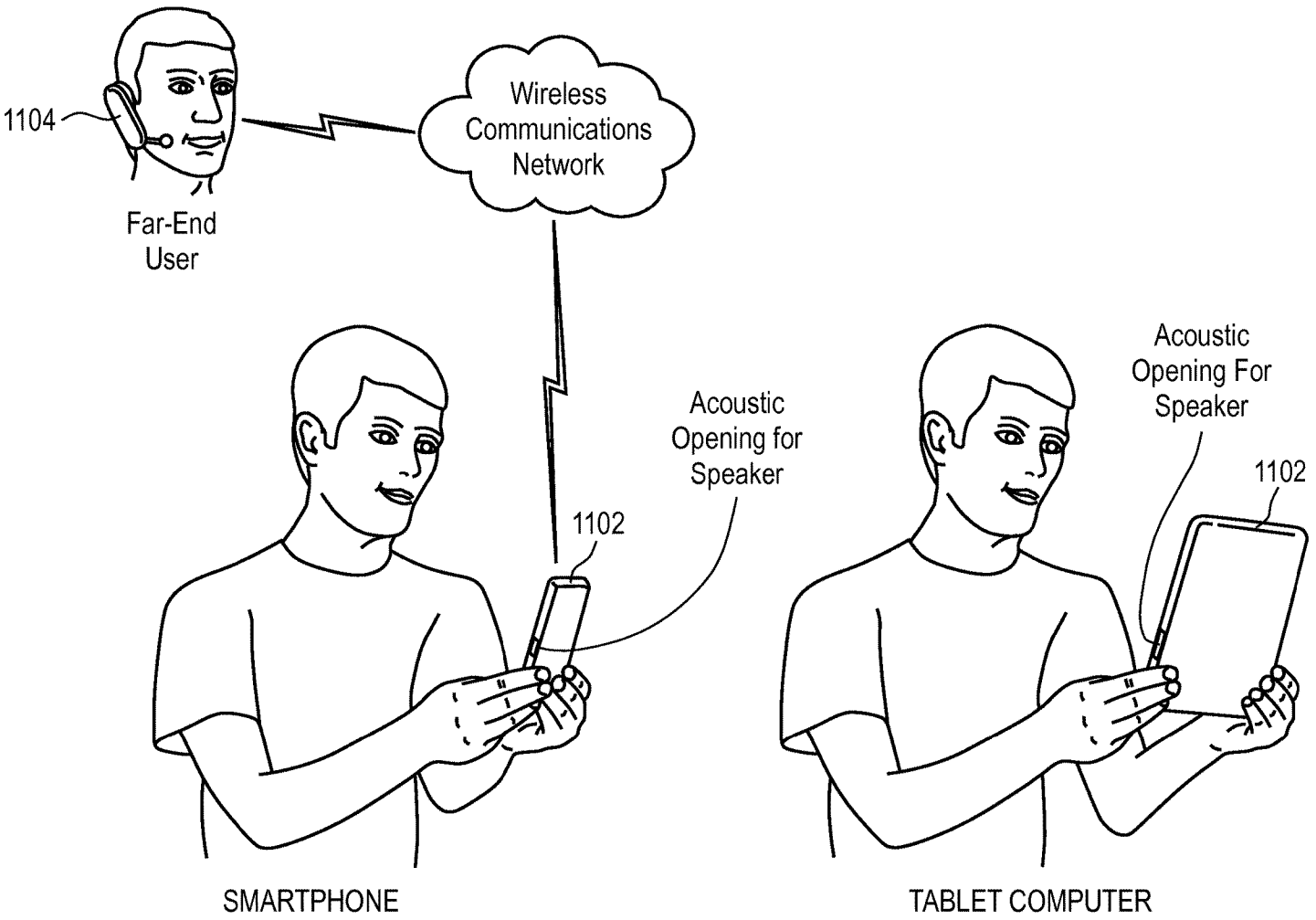
FIG. 11 illustrates one embodiment of a simplified schematic view of one embodiment of an electronic device in which a transducer may be implemented.

FIG. 11 illustrates one embodiment of a simplified schematic view of one embodiment of an electronic device in which a transducer, such as that described herein, may be implemented. As seen in FIG. 11, the transducer may be integrated within a consumer electronic device 1102 such as a smart phone with which a user can conduct a call with a far-end user of a communications device 1104 over a wireless communications network; in another example, the transducer may be integrated within the housing of a tablet computer. These are just two examples of where the transducer described herein may be used, it is contemplated, however, that the transducer may be used with any type of electronic device in which a transducer, for example, a loudspeaker or receiver, is desired, for example, a tablet computer, a desk top computing device or other display device.

Figure 12:
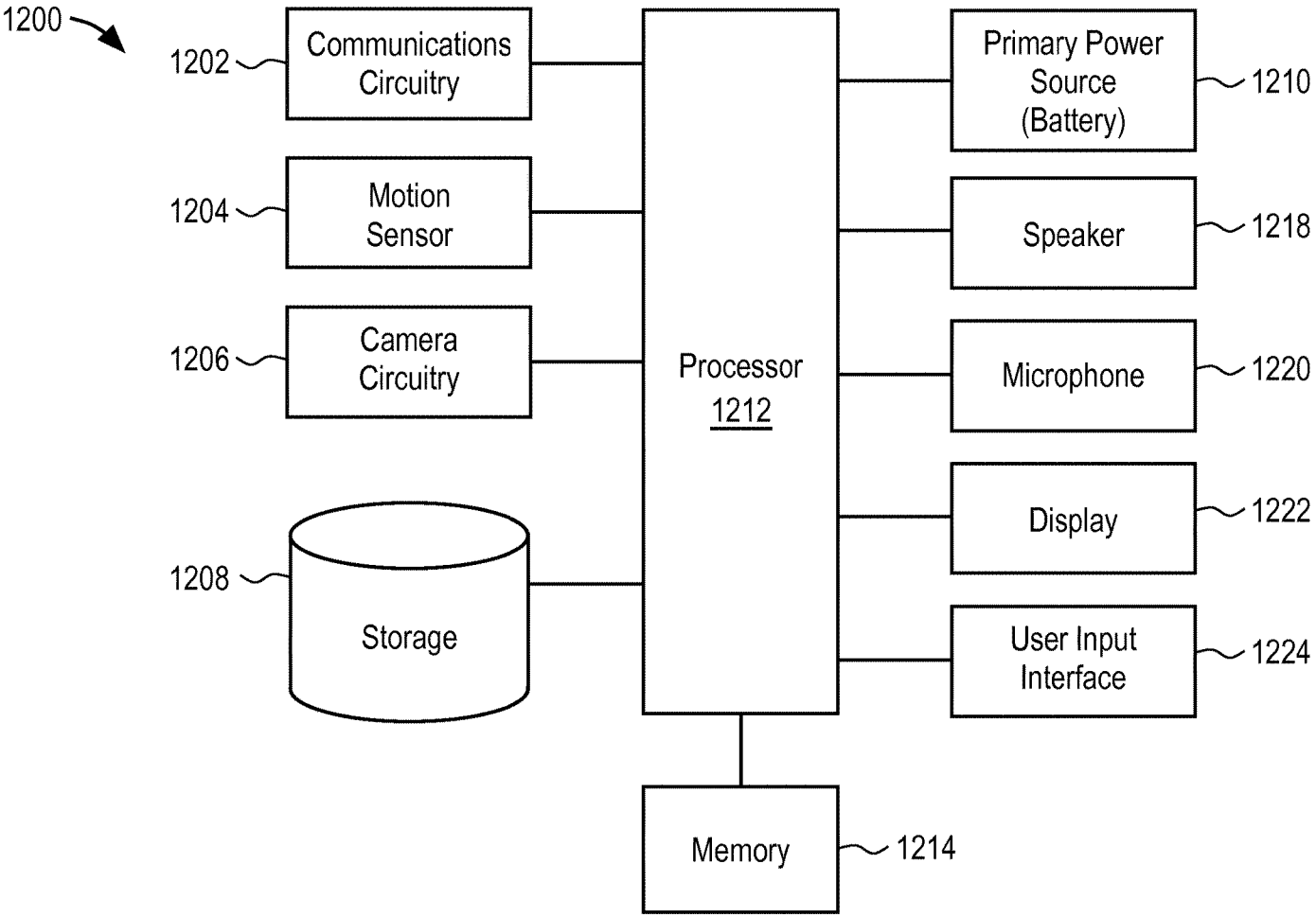
FIG. 12 illustrates a block diagram of some of the constituent components of an embodiment of an electronic device in which an embodiment of the invention may be implemented.

FIG. 12 illustrates a block diagram of some of the constituent components of an embodiment of an electronic device in which an embodiment of the invention may be implemented. Device 1200 may be any one of several different types of consumer electronic devices. For example, the device 1200 may be any transducer-equipped mobile device, such as a cellular phone, a smart phone, a media player, or a tablet-like portable computer.

In this aspect, electronic device 1200 includes a processor 1212 that interacts with camera circuitry 1206, motion sensor 1204, storage 1208, memory 1214, display 1222, and user input interface 1224. Main processor 1212 may also interact with communications circuitry 1202, primary power source 1210, speaker 1218, and microphone 1220. Speaker 1218 may be a microspeaker such as that described in reference to FIG. 1A. The various components of the electronic device 1200 may be digitally interconnected and used or managed by a software stack being executed by the processor 1212. Many of the components shown or described here may be implemented as one or more dedicated hardware units and/or a programmed processor (software being executed by a processor, e.g., the processor 1212).

The processor 1212 controls the overall operation of the device 1200 by performing some or all of the operations of one or more applications or operating system programs implemented on the device 1200, by executing instructions for it (software code and data) that may be found in the storage 1208. The processor 1212 may, for example, drive the display 1222 and receive user inputs through the user input interface 1224 (which may be integrated with the display 1222 as part of a single, touch sensitive display panel). In addition, processor 1212 may send an audio signal to speaker 1218 to facilitate operation of speaker 1218.

Storage 1208 provides a relatively large amount of "permanent" data storage, using nonvolatile solid state memory (e.g., flash storage) and/or a kinetic nonvolatile storage device (e.g., rotating magnetic disk drive). Storage 1208 may include both local storage and storage space on a remote server. Storage 1208 may store data as well as software components that control and manage, at a higher level, the different functions of the device 1200.

In addition to storage 1208, there may be memory 1214, also referred to as main memory or program memory, which provides relatively fast access to stored code and data that is being executed by the processor 1212. Memory 1214 may include solid state random access memory (RAM), e.g., static RAM or dynamic RAM. There may be one or more processors, e.g., processor 1212, that run or execute various software programs, modules, or sets of instructions (e.g., applications) that, while stored permanently in the storage 1208, have been transferred to the memory 1214 for execution, to perform the various functions described above.

The device 1200 may include communications circuitry 1202. Communications circuitry 1202 may include components used for wired or wireless communications, such as two-way conversations and data transfers. For example, communications circuitry 1202 may include RF communications circuitry that is coupled to an antenna, so that the user of the device 1200 can place or receive a call through a wireless communications network. The RF communications circuitry may include a RF transceiver and a cellular baseband processor to enable the call through a cellular network. For example, communications circuitry 1202 may include Wi-Fi communications circuitry so that the user of the device 1200 may place or initiate a call using voice over Internet Protocol (VOIP) connection, transfer data through a wireless local area network.

The device may include a microphone 1220. Microphone 1220 may be an acoustic-to-electric transducer or sensor that converts sound in air into an electrical signal. The microphone circuitry may be electrically connected to processor 1212 and power source 1210 to facilitate the microphone operation (e.g. tilting).

The device 1200 may include a motion sensor 1204, also referred to as an inertial sensor, that may be used to detect movement of the device 1200. The motion sensor 1204 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 1204 may be a light sensor that detects movement or absence of movement of the device 1200, by detecting the intensity of ambient light or a sudden change in the intensity of ambient light. The motion sensor 1204 generates a signal based on at least one of a position, orientation, and movement of the device 1200. The signal may include the character of the motion, such as acceleration, velocity, direction, directional change, duration, amplitude, frequency, or any other characterization of movement. The processor 1212 receives the sensor signal and controls one or more operations of the device 1200 based in part on the sensor signal.

The device 1200 also includes camera circuitry 1206 that implements the digital camera functionality of the device 1200. One or more solid state image sensors are built into the device 1200, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 1208. The camera circuitry 1206 may also be used to capture video images of a scene.

Device 1200 also includes primary power source 1210, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the dual suspension system transducers described herein could be acoustic-to-electric transducers or sensors that convert sound in air into an electrical signal, such as for example, a microphone. The description is thus to be regarded as illustrative instead of limiting.

What is claimed is:

1. A microspeaker comprising:

a frame;

a diaphragm positioned within the frame, the diaphragm having length sides and width sides, wherein the length sides are longer than the width sides;

a magnet positioned below the diaphragm;

a yoke having a base portion positioned below the magnet and yoke sidewalls which extend from the base portion, the yoke sidewalls positioned only along a length dimension of the magnet;

a voice coil having an upper end attached to a bottom face of the diaphragm and a lower end positioned within a gap formed between the length dimension of the magnet and the yoke sidewalls;

a first suspension member having an inner edge attached to the length sides and the width sides of the diaphragm and an outer edge extending to the frame, wherein the first suspension member is within a first plane; and a second suspension member having an inner edge attached to the lower end of the voice coil and an outer edge attached to the frame, wherein the second suspension member is in a second plane different from the first plane and the second suspension member is less compliant in an x-direction than a z-direction.

2. The microspeaker of claim 1 wherein the inner edge of the second suspension member is attached only to a portion of the lower end of the voice coil positioned along the width sides of the diaphragm.

3. The microspeaker of claim 1 wherein the second suspension member has a rectangular profile.

4. The microspeaker of claim 1 wherein the second suspension member is a solid membrane having a width equal to that of the voice coil.

5. The microspeaker of claim 1 wherein the second suspension member comprises two separate suspension members extending from opposing ends of the voice coil.

6. The microspeaker of claim 1 wherein the second suspension member is doped with a conductive material such that the second suspension member is operable to electrically connect the voice coil to circuitry within the frame.

7. The microspeaker of claim 1 wherein the second suspension member is a layered membrane, the layered membrane including at least one electrically conductive layer.

8. The microspeaker of claim 1 wherein the first plane is above the voice coil and the second plane is below the voice coil.

9. The microspeaker of claim 1 wherein an opening is formed in at least one of the yoke sidewalls and the second suspension member extends through the opening to the frame.

10. A transducer comprising:

a frame;

a sound radiating surface positioned within the frame, the sound radiating surface having length sides and width sides, wherein the length sides are longer than the width sides;

a voice coil having an upper end attached to a bottom face of the sound radiating surface and a lower end;

a magnet assembly having a magnet and a yoke, the magnet and the yoke dimensioned to form magnetic gaps below only the length sides of the sound radiating surface, wherein the lower end of the voice coil is positioned within the magnetic gaps;

an upper suspension member connecting the sound radiating surface to the frame, wherein the upper suspension member is above the voice coil; and a lower suspension member connecting the voice coil to the frame, wherein the lower suspension member is attached to a portion of the lower end of the voice coil positioned outside of the magnetic gaps such that the lower suspension member is below the voice coil, and the lower suspension member is stiffer in an x-direction parallel to a surface of the lower suspension member than a z-direction normal to the surface of the lower suspension member.

11. The transducer of claim 10 wherein the sound radiating surface has an aspect ratio greater than or equal to 2.0.

12. The transducer of claim 10 wherein the lower suspension member comprises a first lower suspension member and a second lower suspension member, each of the first lower suspension member and the second lower suspension member being separable structures attached to different portions of the lower end of the voice coil.

13. The transducer of claim 12 wherein the first lower suspension member radiates outwardly from a width side of the voice coil to the frame and the second lower suspension member radiates outwardly from another width side of the voice coil to the frame.

14. The transducer of claim 10 wherein the magnet is a rectangular magnet and the yoke comprises sidewalls positioned along only a length dimension of the rectangular magnet such that the magnetic gaps are formed only along the length dimension of the magnet.

15. A microspeaker comprising:

a frame;

a diaphragm positioned within the frame, the diaphragm having a high aspect ratio;

a magnet positioned below the diaphragm, a yoke having a base portion positioned below the magnet and yoke sidewalls which extend from the base portion, the yoke sidewalls positioned along only two sides of the magnet;

a voice coil having length sides and width sides, each of the length sides and width sides having an upper end attached to a bottom face of the diaphragm and a lower end positioned within a gap formed between the magnet and the yoke sidewalls;

an upper suspension member connecting the diaphragm to the frame, wherein the upper suspension member is above the voice coil; and a lower suspension member connecting the lower end of the voice coil to the frame such that the lower suspension member is below the voice coil, wherein the lower suspension member is attached to the lower end of only the width sides of the voice coil and wherein the lower suspension member is dimensioned to have a lower compliance in an x-direction than a z-direction.

16. The microspeaker of claim 15 wherein the high aspect ratio comprises an aspect ratio greater than or equal to 2.0.

17. The microspeaker of claim 15 wherein the lower suspension member comprises a first section and a second section that are separately attached to the width sides.

18. The microspeaker of claim 15 wherein the voice coil has a rectangular profile.

* * * * *